US006332957B1

(12) United States Patent
Gross et al.

(10) Patent No.: US 6,332,957 B1
(45) Date of Patent: Dec. 25, 2001

(54) METHOD AND DEVICE FOR PRODUCING A COKE COAL CAKE FOR CARRYING OUT A COKING PROCESS IN A FURNACE CHAMBER

(75) Inventors: Peter Gross, Ueberherrn; Frank Kayser, St. Ingberg, both of (DE)

(73) Assignee: Saarberg-Interplan Gesellschaft für Rohstoff-, Energie- und Ingenieurtechnik mbH, Saarbrücken (DE)

( * ) Notice: Subject to any disclaimer, the term of this patent is extended or adjusted under 35 U.S.C. 154(b) by 0 days.

(21) Appl. No.: 09/402,167

(22) PCT Filed: Jan. 27, 1999

(86) PCT No.: PCT/DE99/00208

§ 371 Date: Sep. 30, 1999

§ 102(e) Date: Sep. 30, 1999

(87) PCT Pub. No.: WO99/38934

PCT Pub. Date: Aug. 5, 1999

(30) Foreign Application Priority Data

Jan. 30, 1998 (DE) ..... 198 03 455

(51) Int. Cl.[7] ..... C10B 45/02; C10B 31/00; B30B 11/22

(52) U.S. Cl. ..... 201/6; 201/5; 202/251

(58) Field of Search ..... 201/5, 6; 202/251

(56) References Cited

U.S. PATENT DOCUMENTS 3,650,403 * 3/1972 Aldridge ..... 210/180
3,784,034 * 1/1974 Thompson ..... 214/21
4,111,664 * 9/1978 Leibrock ..... 44/10 G
4,194,951 * 3/1980 Pries ..... 202/227
4,606,876 * 8/1986 Yoshida et al. ..... 264/120
4,620,828 * 11/1986 Lemke ..... 414/684.3
5,994,470 * 8/1999 Bonerb ..... 414/421

FOREIGN PATENT DOCUMENTS

2712111A1 * 9/1978 (DE) .
19545736 * 6/1997 (DE) .
850735 A1 * 7/1998 (EP) .

* cited by examiner

*Primary Examiner*—Bekir L. Yildirim
(74) *Attorney, Agent, or Firm*—James Creighton Wray; Meera P. Narasimhan

(57) ABSTRACT

The aim of the invention is to provide a method and a stamping device which is affiliated with said method. Using known economical stamping techniques, the stamping device permits coke coal cakes which are produced in an edgewise manner to be inserted into a coking furnace in a manner suited for positioning, i.e. in a flat-lying manner. To this end, a coke coal cake (1) having a small cake height and a large cake base surface is stamped inside a stamp die in an edgewise arrangement while using known techniques. Afterwards, the coke coal cake (1) remains in the stamp die and is placed in a position by a tipping and holding device (3) which is placed on the stamp die and which is suited for carrying out functions. In said position, the coke coal cake (1) which has not yet been removed from the die is inserted into the furnace chamber, is removed from the die therein, and is placed on the furnace base. This is especially achieved by using an inventive stamping device which is characterized in that a tipping and holding device (3) is connected to the stamp die of a stamping machine. A setting base (2) is arranged in the tipping and holding device such that the base is both a part of the stamp die and a part of the setting base.

22 Claims, 2 Drawing Sheets

METHOD AND DEVICE FOR PRODUCING A COKE COAL CAKE FOR CARRYING OUT A COKING PROCESS IN A FURNACE CHAMBER

BACKGROUND OF THE INVENTION

The invention concerns a process and a stamping device for stamping a coke coal cake with low cake height and large cake base surface and subsequent introduction into a coking furnace with furnace chamber with a large furnace base surface.

Coking furnaces operating according to the state of the art "non-recovery process" have a large furnace base surface with a comparatively low chamber height of the furnace in order to be able to utilize the heating system of the furnace as optimally, that is, as heat effectively, as possible.

Introducing the coke coals into the furnace chamber here takes place by means of a conveyor belt system as an allotment conveyor whose feeding device is conducted to the open furnace door over a cantilever construction.

This manner of coke coal introduction requires a great expenditure of time, whereby the furnace chamber doors must be opened almost completely to effectively place the charging facility, which is relatively expensive as regards construction, in the furnace chamber for charging.

The introduction of coke coals into the furnace is thereby configured in the following steps:

a) Opening the furnace door;

b) Introducing the charging band (allocation conveyor) and simultaneous filling of the coke coals;

c) Extracting the charging band (allocation conveyor) with simultaneous filling of the coke coals and simultaneous leveling of the coke coal surface;

d) Closing the furnace door.

DE 195 45 736 A1 discloses a process and an associated coking furnace machine for filling a coking furnace with coals. Underlying this is the objective of filling the furnace chamber and compacting the coal introduced, especially in connection with improving non-recovery coke ovens. This takes place according to a process whereby, outside the furnace chamber of the coking furnace, the coals are already poured with uniform height into a coal filling and compacting chamber (the hutch) and subsequently compacted with suitable devices.

U.S. Pat. No. 3,784,034 discloses a process and an associated machine for activating the furnace chamber doors, for pressing the coke out of the furnace chamber and for loading an adjacent, previously emptied furnace chamber with a compact coal charge.

This concerns a combined coking furnace servicing machine for pressing the coke out and for filling the coke coals. To be able to move the coking furnace servicing machine along the front of the furnace chamber, the latter is mounted on rails along the long axis of the block; the head of the pusher has a water-cooled cooling facility to prevent damage and delay owing to the considerable heat of the ejected material and the temperature within the furnace chamber. Filling the empty furnace chamber takes place by means of an endless conveyor as loading conveyor (allocation conveyor). Even with this device, the conveyor discharge is constructed in such a way that it can be set into the furnace chamber of the coking furnace in the manner of a telescope.

Here, the following finding is common to the state of the art processes:

The time interval and the degree of opening of the furnace doors have a disadvantageous action in several respects in connection with the necessary coking temperatures.

First, the furnace chamber cools down very quickly, which once again demands energy and time to bring it up to the coking temperature, and second, all machine parts, even such of the conveyor belt system, are subject to very high wear and tear as a result of the high temperature in a still hot furnace chamber, especially in the initial phase. This brings frequent and cost-intensive maintenance and repair costs along with it, and moreover leads to furnace standstill times during which coke production is at rest.

SUMMARY OF THE INVENTION

The object of the invention is to indicate a process and an associated stamping device which offer the possibility of introducing coke coal cakes produced edgewise with the aid of a stamping technique lying flat into a furnace chamber while avoiding all of the previously mentioned disadvantages if possible.

The object is accomplished in that a coke coal cake is stamped with low cake height and large cake base surface in a familiar manner in edgewise arrangement in a stamp die. Thereafter, the cake remaining in the stamp die is brought into a position by a tipping device mounted suitably for functioning on the stamp die in which the coke coal cake which has not yet been removed from the die is introduced in a manner suited for positioning into the furnace chamber, removed from the die in this and deposited on the furnace base.

For this, the stamping device is constructed such that a tipping and holding device is connected to the stamp die.

This is further configured advantageously if a setting base is arranged in the tipping and holding device such that this is in its respective position part of the stamp die and of the setting base at the same time.

This process proves to be very economical and user-friendly if castors are arranged in the tipping device guiding and supporting the setting base, and the tipping device is driven by telescoping cylinders or other drive components.

DETAILED DESCRIPTION

Figure 1:
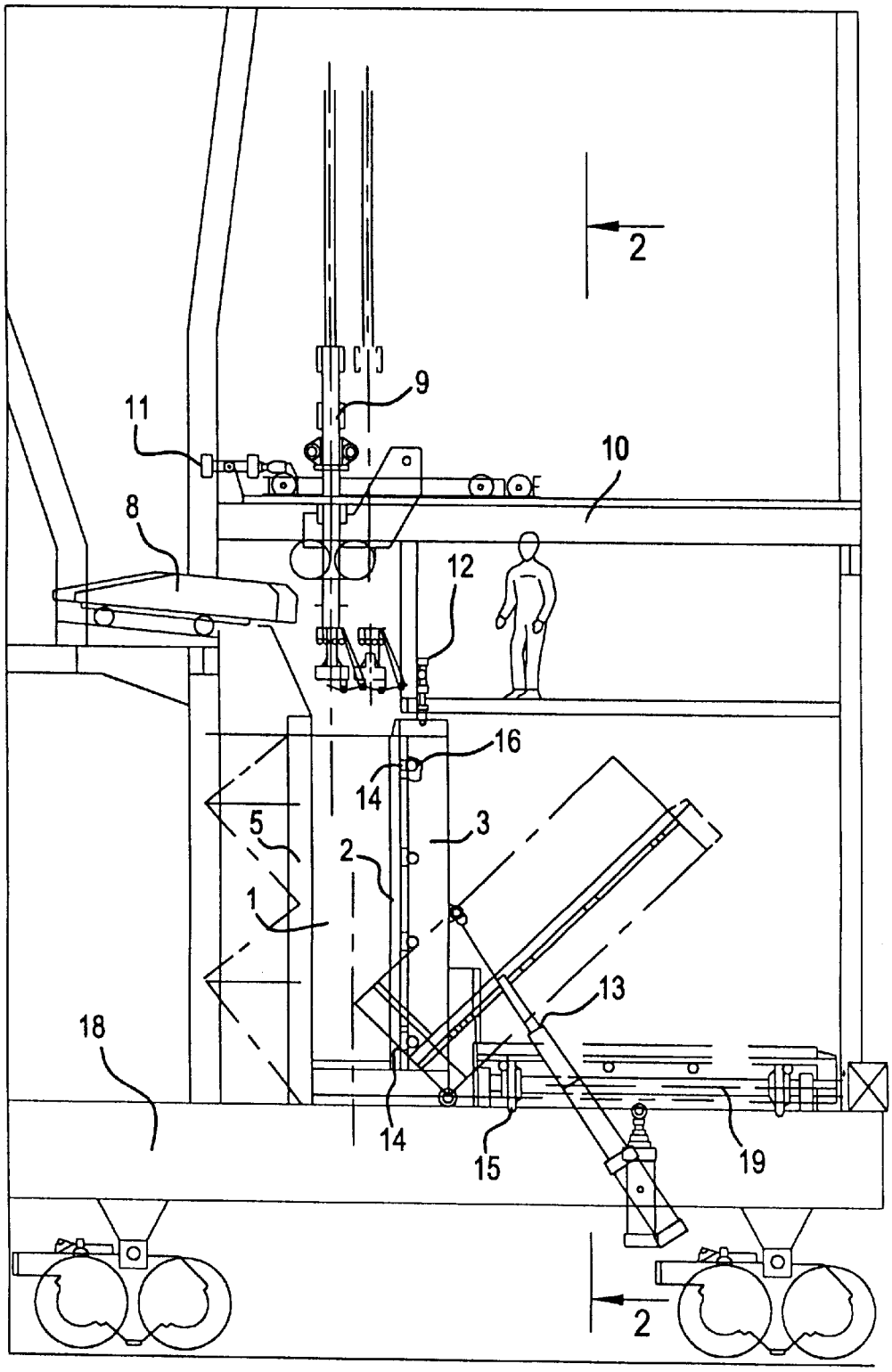
FIG. 1 is a front elevation of the invention.
Figure 2:
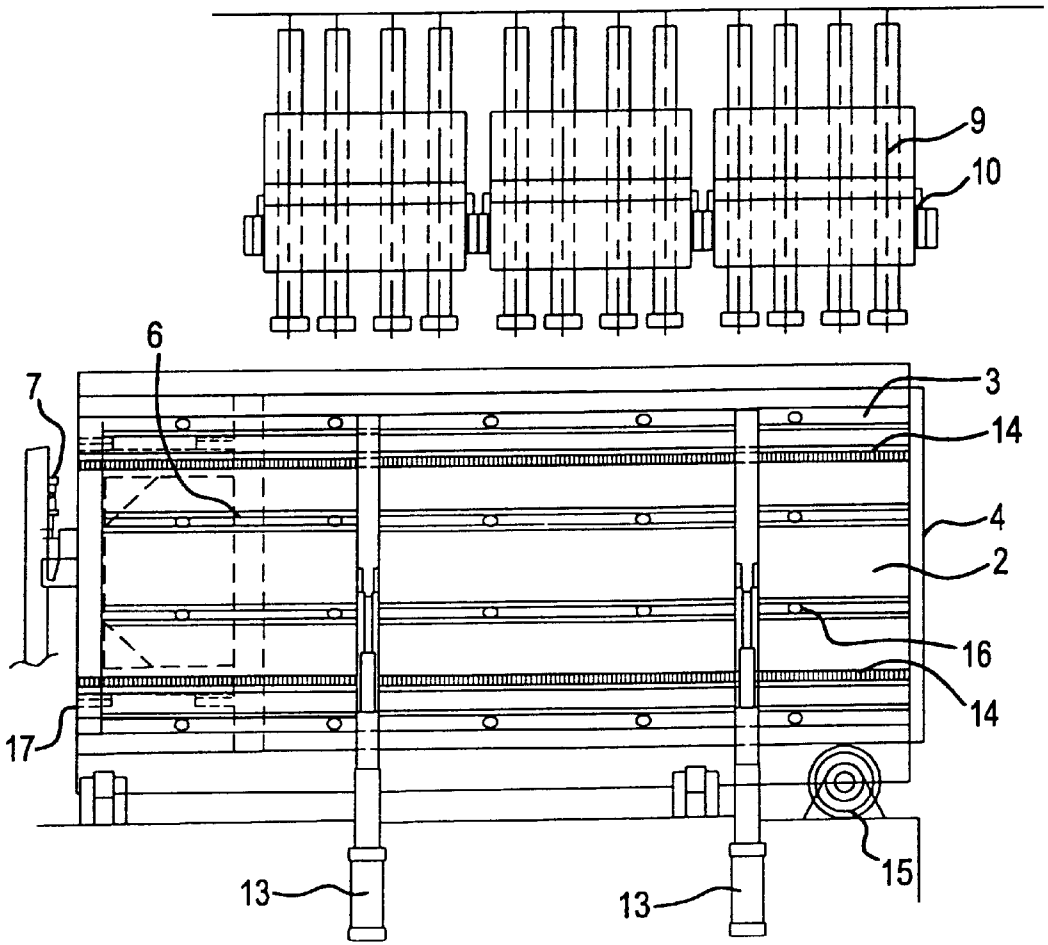
FIG. 2 is a cross-section at AA of FIG. 1.

The two FIGS. 1 and 2 depict an embodiment with the components in accordance with the reference number list. Here the stamping device is constructed so that the front closure 4 of the stamp die is formed by a closure sheet 4 fastened on the fixed stamp die wall 5 which comes out of engagement when the coal cake 1 is swung out, or the front closure 4 of the stamp die is held firm by a movable trap door which is mounted on the tipping and holding device 3 and serves as setting base support, while the setting base 2 is introduced into the furnace chamber in the positioning attitude.

Furthermore, the rear closure 6 of the stamp die is formed by a device which forms a stable closure of the stamp die during the stamping process by locking 7 and after attaining the positioning attitude on castors 17, comes to a stop and forms the setting stand 6.

The setting base 2 is constructed with at least two racks 14 which engage with driving pinions 15 which are arranged on a shafting 19. The racks 14 are moreover constructed under the setting base 2 so that they can at the same time also serve as skids.

The stamping device possesses a stamping facility above the stamp die with several stamper cars 9 which are set up on rails 10 which are arranged crosswise toward the stamp die.

The construction of the stamping device furthermore entails that the stamping facility consists of individually movable stamper cars 9 which are not coupled into a train each of can independently be moved back and forth by conveying drives and thus cover the entire breadth of the coke coal cake.

It should be stressed regarding the mode of action of the facility that the front closure sheet 4 can be a component of the fixed holding construction 5, or can also be mounted on the tipping device 3 and consequently serves as a bridge trap door for the setting base 2. The rear closure sheet forms the setting stand 6. The setting stand thereby lies on its side and is fixed in this position over the locking devices 7.

The coke coal charging takes place gradually through push feeders 8 or other feeding devices. The stamper cars of the stamping facility 9 stand (contrary to known applications) not on rails arranged along the stamp die, but each stamper car has its own rails (tracks) 10 which are arranged across the stamp die. Through this it is possible to move the stamper cars back and forth in a crosswise direction while stamping the coke coal cake with rail shunters 11. Consequently, stamping broad coke coal cakes is possible.

The process is configured such that after the coke coal cake 1 is stamped, the tipping device 12 is unlocked and tips the latter with the setting base 2 and the coke coal cake laterally downward. The drive for the tipping and holding device 3 takes place in this connection for example by telescoping cylinders 13 or other drives. When swinging the tipping device 3 away, the teeth of the racks 14 which are installed under the setting base 2 now engage with the tooth gaps of the drive pinions 15. The setting base 2 lies on the castors 16 which are mounted on the tipping device 3. The setting stand 6 now stands on its traveling wheels 17. The front closure sheet 4 is out of engagement owing to swinging away the coal cake or is swung down in the downswing version and now serves as a bridge trap door 4 for the setting base 2.

The coke coal cake is introduced into the furnace chamber in a known manner: Floor with coke coal cake 1 and setting stand 6 into the furnace chamber-setting stand 6 locked-base back-setting stand 6 unlocked-setting base 2 with setting stand 6 back into the machine 18.

After the setting base 2 is moved back with the setting stand 6 into the machine 18, the setting base with the setting stand is brought into the initial stamping position by the tipping device 3.

Reference Number List

1. Coke coal cake
2. Setting base
3. Tipping and holding device
4. Front closure sheet, either component of 5 or bridging trap door
5. Holding construction
6. Setting stand
7. Locking device
8. Push feeder
9. Stamping facility consisting of stamps
10. Rails (tracks) arranged crosswise to the stamp die for stamper cars
11. Rail shunter (track mover, track shunter, back and forth mover)
12. Tipping device
13. Telescoping cylinder, generally linear drive
14. Racks
15. Drive pinions for racks
16. Castors for tipping device
17. Castors on the setting stand
18. Stamping and setting machine
19. Shafting

What is claimed is:

1. Coking furnace apparatus comprising a stamping device for stamping a coke coal cake and providing into a coking furnace comprising a furnace chamber with furnace surface to accommodate the coal cake, a stamp die for stamping a coke coal cake, the coke coal cake having a cake height less than a cake surface, a positioning device connected to the die for supplying and positioning the die along with the coke coal cake within the furnace chamber and for removing the coke coal cake from the die in the furnace chamber and a base in the furnace chamber for receiving the coke coal cake.

2. The stamping device of claim 1, further comprising a stamping machine for the die, wherein the positioning device comprises a tipping and holding device connected to the die.

3. The stamping device of claim 2, wherein the tipping device has a setting base, wherein the setting base is common to the die and the tipping device.

4. The stamping device of claim 3, further comprising castors on the tipping device for guiding and supporting the setting base.

5. The stamping device of claim 2, further comprising a driver for driving the tipping device.

6. The stamping device of claim 5, wherein the driver is telescoping cylinders.

7. The stamping device of claim 1, wherein the die comprises a front closure and a fixed wall, a closure sheet connected to the fixed wall forming the front closure, wherein the fixed wall is formed when the coke coal cake is disengaged.

8. The stamping device of claim 7, wherein the front closure is a movable trap door on the tipping device and wherein the trap door forms a setting base support when the coke coal cake is moved into the furnace chamber.

9. The stamping device of claim 2, wherein the die comprises a rear closure formed by a stable closure locked during a stamping process and castors for suitably positioning the die, wherein the stable closure forms a setting stand after the castors come to a stop.

10. The stamping device of claim 3, wherein the setting base comprises at least two racks and drive pinions for engaging the racks.

11. The stamping device of claim 10, wherein the racks are adapted for serving as skids.

12. The stamping device of claim 2, further comprising a stamping facility having stamping cars arranged on a shafting positioned above the die, and rails for the shafting running crosswise to the die.

13. The stamping device of claim 12, further comprising a train in the stamping facility, wherein the stamping cars are individually movable independent of the train and wherein the train is movable back and forth for covering an entire breadth of the coke coal cake.

14. Process for stamping a coke coal cake and subsequent introduction into a coking furnace comprising providing a furnace chamber with a furnace surface, stamping the coke coal cake having a height less than a cake surface in an edgewise arrangement by means of a stamp die, bringing the coke coal cake along with the stamp die into the furnace by a tipping device installed on the stamp die, positioning the coke coal cake and the die in the furnace chamber, removing the coke coal cake from the die and depositing the coal cake on a furnace base.

15. The process of claim 14, further comprising providing a setting base on the tipping device such that the setting base is common to the stamp die and the tipping device.

16. The process of claim 15, further comprising guiding and supporting the setting base on castors provided on the tipping device.

17. The process of claim 14, further comprising driving the tipping device by telescoping cylinders or a driver device.

18. The process of claim 14, further comprising providing a closure sheet for forming a front closure of the stamp die and fastening the sheet to a fixed stamp die wall formed when the coke coal cake comes out of engagement when swung out.

19. The process of claim 18, further comprising providing a movable trap door on the tipping device and allowing the movable trap door to serve as a setting base support when the coke coal cake is moved into the furnace chamber.

20. The process of claim 14, further comprising forming a rear closure of the stamp die by locking during the stamping process and forming a setting stand when castors come to a stop after reaching a-suitable positioning.

21. A stamping system for coke coal cakes produced in an edgewise manner comprising a stamping device having a stamp die, a coking furnace for receiving the coke coal cake and holding the cake in a flat-lying manner, the coke coal cake having a smaller cake height than a cake base surface, a tipping and holding device connected to the stamp die for positioning the coke coal cake along with the stamp die in the coking furnace, wherein the tipping and positioning device inserts cake and the die into the furnace, removes the cake from the die and places the cake on a furnace base.

22. The system of claim 21, further comprising a setting base arranged in the tipping and holding device such that the base is a part of the stamp die and a part of the setting base.

* * * * *